United States Patent [19]

Solomon

[11] Patent Number: 4,601,398

[45] Date of Patent: Jul. 22, 1986

[54] FRAME FOR HANGING FILES

[75] Inventor: Jack Solomon, Long Beach, N.Y.

[73] Assignee: Esselte Pendaflex Corporation, Garden City, N.Y.

[21] Appl. No.: 593,604

[22] Filed: Mar. 26, 1984

[51] Int. Cl.[4] ..... A47B 65/00

[52] U.S. Cl. ..... 211/46; 211/182

[58] Field of Search ..... 211/46, 45, 11, 183, 211/182; 312/184; 248/225.4; 403/347

[56] References Cited

U.S. PATENT DOCUMENTS

| | | | |
|---|---|---|---|
| 1,259,659 | 3/1918 | Myers | 312/184 X |
| 2,278,403 | 3/1942 | Jonas | 312/184 |
| 3,860,119 | 1/1975 | Irvine et al. | 312/184 X |
| 3,999,663 | 12/1976 | Walter | 312/184 X |
| 4,488,698 | 12/1984 | Delafield | 211/182 X |

FOREIGN PATENT DOCUMENTS

| | | | |
|---|---|---|---|
| 1520720 | 3/1968 | France | 248/225.4 |
| 1138757 | 1/1969 | United Kingdom | 211/182 |

*Primary Examiner*—Ramon S. Britts
*Assistant Examiner*—Sarah A. Lechok Eley
*Attorney, Agent, or Firm*—Darby & Darby

[57] ABSTRACT

A frame for supporting a multiplicity of files that have reenforced top edges formed with extensions intended to engage a pair of horizontal side rails and that have a web extending between the edges and hanging downwardly there between comprises a pair of horizontal side rails engageable by the extensions. Each side rail is formed with at least one aperture extending therethrough near each end thereof. A pair of end supports each comprising a horizontal cross bar and a pair of vertical legs is provided, the legs and cross bar of each end support having generally the shape of an inverted U. Each leg is formed on the side thereof opposite the other leg of the same end support and near the top thereof with a recess and a threaded bore. Each bore communicates at one end with one of the recesses and at the other end with the side of the leg facing the other leg of the same end support. Four threaded bolts are provided, each having a threaded shank passing through an aperture in the side rail and one of the threaded bores. Each aperture in the side rail has a diameter greater than that of the shank, and the shank is threaded into the bore. Each recess is formed to engage a side rail adjacent top and bottom edges thereof and to be otherwise spaced apart therefrom.

5 Claims, 4 Drawing Figures vertical legs 34, 36 or 38, 40. The legs and cross bar of each end support have generally the shape of an inverted U.

Each leg 34, 36, 38, 40 is formed on the side thereof opposite the other leg of the same end support and near the top thereof with a recess best shown by way of example at 42 in FIG. 3 and with a threaded bore 44 having two ends 46 and 48. Each of the bores 44 communicates at one end, for example, the end 48, with one of the recesses such as the recess 42 shown in FIG. 3, and at the other end, in this example the end 46, with the side 50 of the leg (which can be, for example, the leg 36) facing the other leg (in this example the leg 34 shown in FIG. 1) of the same end support.

Four threaded bolts 52, 54, 56, 58 are provided, and one of them, for example the bolt 52, is shown in Fig. 3 on a larger scale. Each bolt has a threaded shank, such as the shank 60, passing through an aperture such as 24 in the side rail and one of the threaded bores, for example, the bore 44. Each aperture such as 24 in the side rail such as 16 has a diameter greater than that of the shank 60, and the shank 60 is threaded into the bore 44.

In accordance with the invention, each recess such as 42 is formed to engage a side rail such as 16 (FIG. 3) adjacent top and bottom edges 65 and 67 thereof, and to be otherwise spaced apart therefrom.

The invention is preferably characterized by a number of additional features. In particular, it is preferred that the bolts be formed with heads such as 69 which are on the outer side of the frame. This facilitates assembly since the bolts can be reached more easily from the outside of the frame than from the inside.

Moreover, the side rails 16 and 18 are preferably scored adjacent at least one end. Score lines 70, 72 are best shown in FIG. 2. The apertures 20, 22, 24, etc. are spaced apart in a lengthwise direction with respect to the rail 16 or 18. Thus, the distances between the end supports 26 and 28 may be selected by selection of the apertures 20, 22, 24, etc., through which the bolt shanks pass, and the side rails 16 and 18 may be broken off to minimize protrusions beyond the end supports 26 and 28, as FIG. 1 clearly shows.

Each recess 42 is preferably formed with an upper wall 80 that slopes in and down and a lower wall 82 that slopes in and up (FIG. 3), and each recess 42 furthermore preferably has a depth at least substantially as great as the thickness of the side rail such as 16 assembled therein. Thus, tightening of the bolts 52 wedges the side rails 16 and 18 in their corresponding recesses.

The walls 80 and 82 are preferably substantially plane.

Thus, there is provided in accordance with the invention a novel and highly-effective frame for storing hanging files. A frame constructed in accordance with the invention has fewer parts and is lighter, less expensive and easier to assemble than conventional frames. Many modifications of the preferred embodiment of the invention disclosed above will readily occur to those skilled in the art upon consideration of this disclosure. For example, the number and the spacing of apertures 20, 22, 24, etc., the depth of the score lines 70, 72, etc., and the height of the side rails 16 and 18 above the bottoms of the legs 34, 36, 38 and 40 may be adjusted to fit the circumstances of a particular case. Accordingly, the invention is to be construed as covering all embodiments thereof which are within the scope of the appended claims.

What is claimed is:

1. A frame for supporting a multiplicity of files that have reenforced top edges formed with extensions intended to engage a pair of horizontal parallel side rails and that have a web extending between said edges and hanging downwardly therebetween, said frame comprising:

a pair of horizontal side rails engageable by said extensions, each side rail being formed with at least one aperture extending therethrough near each end thereof;

a pair of end supports each comprising a horizontal cross bar and a pair of vertical legs, the legs and cross bar of each end support having generally the shape of an inverted U;

each leg being formed on the side thereof opposite the other leg of the same end support and near the top thereof with a recess and with a threaded bore having two ends, each bore communicating at one of said ends with one of said recesses and at the other of said ends with the side of the leg facing the other leg of the same end support, the recess being within the lateral dimensions of the end support so as not to cause any substantial lateral projection beyond the legs, said side rails being wedged entirely within said recess so as to be entirely within the lateral dimensions of the end support and parallel to the legs;

four bolts each having a threaded shank passing through an aperture in one of said side rails and one of said threaded bores, each aperture in said side rails having a diameter greater than that of said shank, and said shank being threaded into one of said bores; and each recess engaging a side rail adjacent top and bottom edges thereof and being otherwise spaced apart therefrom.

2. A frame according to claim 1 wherein said bolts are formed with heads respectively on the outer sides of said frame.

3. A frame according to claim 1 wherein said side rails are respectively scored adjacent at least one end and are formed with a plurality of apertures spaced apart in a lengthwise direction with respect to said rails adjacent at least one end thereof, whereby the distance between said end supports may be selected by selection of the apertures througn which said bolt shanks pass and said side rails may be broken off to minimize protrusions beyond said end supports.

4. A frame according to claim 1 wherein each recess is formed with an upper wall that slopes in and down and a lower wall that slopes in and up and has a depth at least substantially as great as the thickness of the side rail assembled therein, such that tightening of said bolts wedges said side rails in said recesses.

5. A claim according to claim 4 wherein said rails are substantially planar.

* * * * *

FRAME FOR HANGING FILES

BACKGROUND OF THE INVENTION

This invention relates to frames for supporting files and, more particularly, to a novel and highly-effective frame adapted to fit into a desk drawer or similar housing and to support a multiplicity of hanging files. The files themselves are conventional. Each has a pair of reenforced top edges, and each edge is formed with an extension at each end. The extensions are adapted to engage a pair of parallel spaced-apart horizontal side rails, and a web for holding papers, etc., extends between the reenforced edges and hangs downwardly therebetween.

Frames holding such hanging files are well known and have changed little over the years. They typically comprise a pair of end supports each formed in two pieces. The pair of parallel horizontal side rails that extend between the end supports are clamped at opposite ends between the two pieces of each end support.

The bottom piece of each end support is genarally U-shaped with a horizontal flange at the top of each leg of the "U", and the top piece of each end support is a horizontal bar that extends across the top of the U and flairs upwardly at each end to provide a space for inserting and clamping the ends of the parallel horizontal side rails.

This conventional frame has served adequately for many years but has certain drawbacks. It has more parts and is more expensive and harder to assemble than is desirable in a "low-technology" consumer item. In particular:

1. The typical conventional frame has at least 10 parts (two side rails, two end supports each comprising a lower U member and an upper cross bar, and four fastening means each comprising at least one part).

2. Because of this construction, each end support when assembled has generally the shape of a rectangle (a lower U member capped by an upper cross bar). This consumes a substantial amount of material (usually metal) and limits the number of frames that can be packed in a shipping carton without exceeding acceptable weight norms.

3. The substantial weight of the conventional frame adversely affects not only the cost of materials but also the shipping expense; and the relatively complex design adversely affects manufacturing costs. All of these factors combine to increase the cost of a conventional frame for hanging files to a level that militates against the realization of the full potential of the hanging file method of storage.

4. For reasons of economy, frames for hanging files are shipped knocked down and must usually be assembled by the end user. While the conventional frames are not highly complex, written assembly instructions are necessary, and tests have shown that an average of 5 to 7 minutes is required for assembly by an untrained person, some end users being unable to complete the assembly at all.

SUMMARY OF THE INVENTION

An object of the invention is to provide a new frame for supporting hanging files which has fewer parts and is lighter, less expensive and easier to assemble than conventional frames, with no appreciable sacrifice of sturdiness or rigidity.

The foregoing and other objects are attained in a frame for supporting a multiplicity of files that have reenforced top edges formed with extensions intended to engage a pair of horizontal parallel side rails and that have a web extending between the edges and hanging downwardly therebetween.

As broadly conceived, the frame comprises a pair of horizontal parallel side rails engageable by the extensions, each side rail being formed with at least one aperture extending therethrough near each end thereof. A pair of end supports is provided, each comprising a horizontal cross bar and a pair of vertical legs, the legs and the cross bar of each end support having generally the shape of an inverted U.

Each leg is formed on the side thereof opposite the other leg of the same end support and near the top thereof with a recess and with a threaded bore having two ends. Each bore communicates at one of its two ends with one of the recesses and at the other end with the side of the leg facing the other leg of the same end support.

Four threaded bolts are provided, each having a threaded shank passing through an aperture in the side rail and one of the threaded bores. Each aperture in the side rails has a diameter greater than that of the shank, and the shank is threaded into the bore.

In accordance with the invention, each recess is formed to engage a side rail adjacent the top and bottom edges thereof and to be otherwise spaced apart therefrom.

The frame preferably is also characterized by other features disclosed below.

BRIEF DESCRIPTION OF THE DRAWING

A better understanding of the invention can be gained from the following detailed description of the preferred embodiment thereof, in conjunction with the appended drawing, wherein.

DESCRIPTION OF THE PREFERRED EMBODIMENTS

Figure 1:
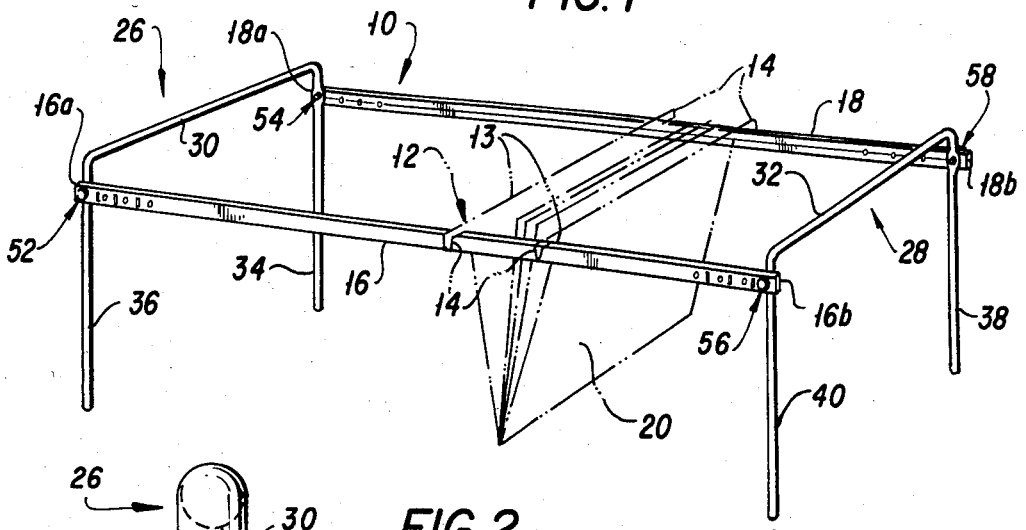
FIG. 1 is a perspective view showing in solid outline a frame constructed in accordance with the invention and in broken outline a conventional hanging file supported thereby.

FIG. 1 shows a frame 10 constructed in accordance with the invention and intended to supported a multiplicity of files 12. Each File has reenforced top edges 13 formed with extensions 14 intended to engage a pair of horizontal parallel side rails 16 and 18. Each file 12 also has a web 20 extending between the edges 13 and hanging downwardly therebetween.

Figure 2:
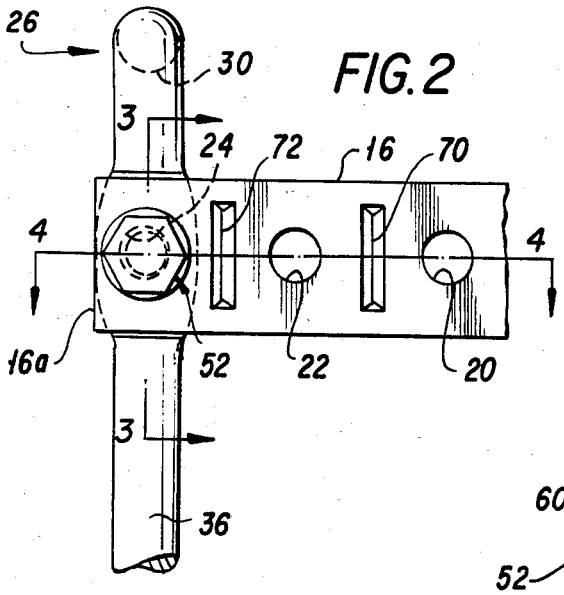
FIG. 2 is a side elevational view on a larger scale of a portion of the frame of FIG. 1.
Figure 3:
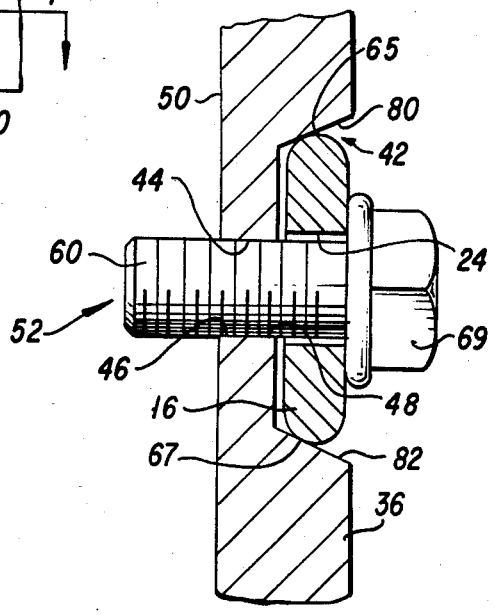
FIG. 3 is a sectional view on still a larger scale taken along the line 3—3 of FIG. 2 and looking in the direction of the arrows.
Figure 4:
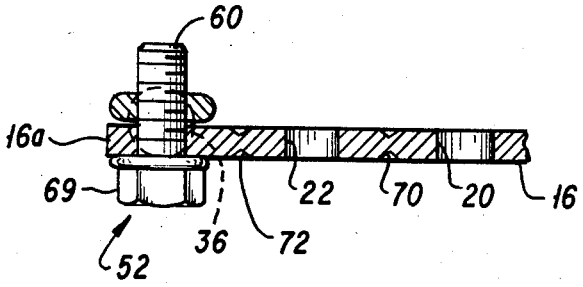
FIG. 4 is a sectional view on substantially the scale of FIG. 2 taken along the line 4—4 of FIG. 2 and looking the direction of the arrows.

The frame 10 comprises the horizontal parallel side rails 16 and 18 mentioned above, which are engageable by the extensions 14. Each side rail 16 and 18 is formed with at least one aperture 20, 22, 24 (Fig.2) extending therethrough near each end 16A, 16B and 18A, 18B thereof.

A pair of end supports 26, 28 is provided, each comprising a horizontal cross bar 30 or 32 and a pair of